US010099286B2

(12) United States Patent
Chen et al.

(10) Patent No.: US 10,099,286 B2
(45) Date of Patent: Oct. 16, 2018

(54) PREPARATION METHOD OF ELECTRICAL CONTACT MATERIAL

(71) Applicant: WENZHOU HONGFENG ELECTRICAL ALLOY CO., LTD., Yueqing, Zhejiang (CN)

(72) Inventors: Lesheng Chen, Zhejiang (CN); Yuhang Chen, Zhejiang (CN)

(73) Assignee: WENZHOU HONGFENG ELECTRICAL ALLOY CO., LTD., Yueqing, Zhejiang (CN)

( * ) Notice: Subject to any disclaimer, the term of this patent is extended or adjusted under 35 U.S.C. 154(b) by 820 days.

(21) Appl. No.: 14/890,908

(22) PCT Filed: Mar. 21, 2013

(86) PCT No.: PCT/CN2013/072978
§ 371 (c)(1),
(2) Date: Nov. 17, 2015

(87) PCT Pub. No.: WO2014/029210
PCT Pub. Date: Feb. 27, 2014

(65) Prior Publication Data

US 2016/0074935 A1 Mar. 17, 2016

(30) Foreign Application Priority Data

Aug. 20, 2012 (CN) ..... 2012 1 0296608
Aug. 20, 2012 (CN) ..... 2012 1 0296634

(51) Int. Cl.

| | |
|---|---|
| ***B22F 3/10*** | (2006.01) |
| ***B22F 1/00*** | (2006.01) |
| ***C22C 5/06*** | (2006.01) |
| ***H01H 1/023*** | (2006.01) |
| ***B22F 1/02*** | (2006.01) |
| ***B22F 3/20*** | (2006.01) |
| ***C22C 32/00*** | (2006.01) |
| ***B22F 3/24*** | (2006.01) |
| ***C23C 18/32*** | (2006.01) |
| ***C23C 18/42*** | (2006.01) |
| ***C22C 1/10*** | (2006.01) |

(52) U.S. Cl.
CPC ..... *B22F 1/0003* (2013.01); *B22F 1/025* (2013.01); *B22F 3/10* (2013.01); *B22F 3/1007* (2013.01); *B22F 3/20* (2013.01); *B22F 3/24* (2013.01); *C22C 1/1084* (2013.01); *C22C 5/06* (2013.01); *C22C 32/0021* (2013.01); *C23C 18/32* (2013.01); *C23C 18/42* (2013.01); *H01H 1/023* (2013.01); *B22F 2201/02* (2013.01); *B22F 2302/10* (2013.01); *B22F 2302/25* (2013.01); *B22F 2998/10* (2013.01); *B22F 2999/00* (2013.01)

(58) Field of Classification Search
CPC .. B22F 3/10; B22F 3/1007; B22F 3/20; B22F 3/24; H01H 1/023; C23C 18/32
USPC ..... 419/28, 29
See application file for complete search history.

(56) References Cited

U.S. PATENT DOCUMENTS 4,622,269 A * 11/1986 Leung ..... H01H 1/0231 200/265

FOREIGN PATENT DOCUMENTS

| | | |
|---|---|---|
| CN | 102808097 A | 12/2012 |
| CN | 102808098 A | 12/2012 |

* cited by examiner

*Primary Examiner* — Mark A Chapman

(57) ABSTRACT

A preparation method of an electrical contact material includes steps of: adopting chemical plating to cover nickel coating on aquadag or metallic oxide, then covering with silver coating, and forming Ag—Ni—C or Ag—Ni—MeO core-shell structure, which improves interface wettability of aquadag, metallic oxide and silver matrix, and removes the adverse effect on the electrical contact material mechanical property due to bad interface wettability in conventional powder metallurgy method. What is important is that the silver in intermediate composite particles is replaced by nickel coating, thus reduce the silver use level. The main function of silver coating is to improve inoxidizability of composite particles, sintering granulation property and the deformability during the manufacturing process of intermediate composite particles, thus improve the technological property.

18 Claims, No Drawings

PREPARATION METHOD OF ELECTRICAL CONTACT MATERIAL

CROSS REFERENCE OF RELATED APPLICATION

This is a U.S. National Stage under 35 U.S.C 371 of the International Application PCT/CN2013/072978, filed Mar. 21, 2013, which claims priority under 35 U.S.C. 119(a-d) to CN 201210296634.7, filed Aug. 20, 2012; and CN 201210296608.4, filed Aug. 20, 2012.

BACKGROUND OF THE PRESENT INVENTION

Field of Invention

The present invention relates to an electrical contact material, and is especially a preparation method of an electrical contact material.

Description of Related Arts

Silver based electrical contact is core element of electric switch, taking charge of connecting and disconnecting between circuits and widely used in low-voltage apparatuses, such as various air switches, relay, ac/dc contactor, etc. In recent years, with the continuous improvement of industrial application level and cost-performance demand, new preparation technologies and silver based electrical contact composite materials have been being launched constantly.

Through searching the existing technologies, there is a new electrical contact material preparation method disclosed by 2011 declared authorized Chinese patent (201010579827.4, the preparation method of particle orientation arrangement reinforced silver based electrical contact material). Firstly, prepare Ag-coated enforced particle's intermediate composite particle with chemical plating coating method. Secondly, further mix intermediate composite particles with pure silver powder to reduce reinforcement content to finished product level. Thirdly, conduct powder-mixing, pressing, sintering and hot-extruding, etc. Finally, obtain a new electrical contact material, where the enforced particles in the matrix present fibrous arrangement.

The conventional powder metallurgy technologies usually perform one-time mixing of reinforcement powder and silver powder. Due to reinforcement powder particle size distribution, a considerable proportion of ultrafine reinforcement powder excessively disperse in silver matrix, thus lower the electrical contact material's electric conductivity and elongation. Above technical principle means to restrain fibrous arrangement form of enforced particles in local region, as such form harmfully affect material electrical property and mechanical property, thus improve the material electric conductivity and elongation. The silver in such local region only plays the role of reinforcement carrier, while the contribution of precious metal silver therein to the integral material's electric conductivity and elongation is limited.

Through further literature search, the main inventor of above invention patent published a research article entitled "Ag/($SnO_2$)12 Electrical Contact Material with Fibre-like Arrangement of Reinforcing Nanoparticles: Preparation, Formation Mechanism, and Properties" on 26$^{th}$ International Conference on Electrical Contact (ICEC2012) in May 2012. This article introduced the preparation method and material property based on similar theory. The specific description as follows: firstly, utilize mechanical alloying to prepare Ag/($SnO_2$) intermediate composite particles with 60% $SnO_2$. Secondly, mix Ag/($SnO_2$) intermediate composite particles and pure silver powder by 1:4 to reduce $SnO_2$ to 12%. Thirdly, conduct subsequent techniques such as pressing, sintering and hot-extruding, etc. Finally, obtain the new Ag/($SnO_2$) environmental electrical contact material, where $SnO_2$ in the silver matrix present fibrous arrangement. Compared with the conventional powder metallurgy technology, the electrical resistivity reduces from 2.31 μΩ·cm to 2.08 μΩ·cm, and the elongation increases from 7% to 24%.

SUMMARY OF THE PRESENT INVENTION

The present invention, on base of the technical principles of above literature, provides a preparation method of an electrical contact material. Replace precious metal silver with nickel as the carrier of aquadag or metallic oxide to prepare intermediate composite particles of nickel/metallic oxide or nickel/aquadag. Thus restrain aquadag or metallic oxide in intermediate composite particles, avoiding the adverse effect of ultrafine metallic oxide powder on electrical contact material property.

The present invention is realized by following technical solution: adopting chemical plating to cover a nickel coating on aquadag or metallic oxide, then covering with a silver coating, forming Ag—Ni—C or Ag—Ni—MeO core-shell structure, which improves interface wettability of the aquadag, metallic oxide and a silver matrix, and removes an adverse effect on electrical contact material mechanical property due to bad interface wettability in conventional powder metallurgy method. What is important is that the silver in intermediate composite particles is replaced by the nickel coating, thus reduce a silver use level. The main function of the silver coating is to improve inoxidizability of composite particles, sintering granulation property and the deformability during the manufacturing process of intermediate composite particles, thus improve the technological property.

The specific procedure of above method of the present invention is as follows:

1$^{st}$ step, adopting chemical plating to cover a nickel coating on aquadag or metallic oxide particles;

2$^{nd}$ step, adopting chemical plating to further cover a silver coating on the aquadag or the metallic oxide particles with the nickel coating by the 1$^{st}$ step;

3$^{rd}$ step, adopting nitrogen protection to conduct sintering granulation to powder of Ag—Ni—C or Ag—Ni—MeO core-shell structure which is formed by the 2$^{nd}$ step, and obtaining intermediate composite particle powder, then sieving;

4$^{th}$ step, mixing the intermediate composite particles after sieving by the 3$^{rd}$ step with pure silver powder to reduce a content of aquadag or metallic oxide to a setting value; and 5$^{th}$ step, making well-mixed powder of the 4$^{th}$ step pressed and nitrogen protection atmosphere sintered, then extruding and drawing to obtain the electrical contact material where the aquadag or the metallic oxide present fibrous arrangement in a local region; wherein in the local region, there are mainly nickel and a small quantity of silver besides aquadag reinforcement or metallic oxide reinforcement.

Above method:

Preferably, in the 1$^{st}$ step, an average weight percentage of the aquadag in the nickel coating powder after adopting the chemical plating is 5%-60%, and the nickel weight percentage is 40%-95%.

Preferably, in the 1$^{st}$ step, the average weight percentage of the metallic oxide in the nickel coating powder after adopting the chemical plating is 40%-80%, and the average weight percentage of the nickel is 20%-60%.

Preferably, in the $2^{nd}$ step, the average weight percentage of the silver in the silver coating powder after adopting the chemical plating is less than 10%.

Preferably, in the $3^{rd}$ step, about the sintering granulation, a sintering temperature is 700° C.-900° C.

Preferably, the $3^{rd}$ step further comprises sieving the obtained intermediate composite particle powder, wherein a remaining granularity is −100 meshes-+400 meshes.

Preferably, the $4^{th}$ step specifically comprises mixing the intermediate composite particles with the pure silver powder to reduce the weight percentage of the aquadag to 1%-15%.

Preferably, the $4^{th}$ step specifically comprises mixing the intermediate composite particles with the pure silver powder to reduce the weight percentage of the metallic oxide to 8%-20%.

In above method of the present invention, the metallic oxide is the matter which is applicable to electrical contact material and capable of realizing above purposes. Preferably, the metallic oxides comprise CdO, $SnO_2$, ZnO, CuO, $Ni_2O$, $WO_3$ and mixtures thereof.

With the method of the present invention, the electrical contact materials are obtained through conventional method of $4^{th}$ step and $5^{th}$ step that powder-mixing, powder-pressing, nitrogen protection atmosphere sintering, extruding and drawing. In these materials, the aquadag particles or the metallic oxide particles present fibrous arrangement in the local region, which means the fibrous structure consists of orientation arrangement of the aquadag particles or the metallic oxide particles. Besides the aquadag reinforcement in such local region, there are mainly the nickel and a small quantity of the silver.

The present invention adopts chemical plating to cover the nickel coating on the aquadag or the metallic oxide, then covers with the silver coating, forming the Ag—Ni—C or Ag—Ni—MeO core-shell structure, which improves the interface wettability of the aquadag, the metallic oxide and the silver matrix, and removes the adverse effect on electrical contact material mechanical property due to bad interface wettability by conventional powder metallurgy method. What is important is replacing the silver in the intermediate composite particles by the nickel coating, and reducing the silver use level. The main function of the silver coating is to improve inoxidizability of composite particles, sintering granulation property and the deformability during the manufacturing process of intermediate composite particles, thus improving the technological property.

DETAILED DESCRIPTION OF THE PREFERRED EMBODIMENT

The detailed description of embodiments is as follows: the embodiments, under the premise of technical solution of the present invention, provide detailed implementation way and specific operation process, but the protection scope of the present invention is not limited to the following embodiments.

The present invention adopts chemical plating to cover nickel coating on aquadag, and then covers with silver coating, forming Ag—Ni—C core-shell structural composite powder. Therein the operation of following embodiments can realize chemical nickel-plating and silver-plating, but not limited to, also realized by other existing chemical plating ways. A $4^{th}$ step and a $5^{th}$ step respectively adopt existing method comprising powder-mixing, powder-pressing, nitrogen protection atmosphere sintering, extruding and drawing, but not limited to the operation and technological parameters of following embodiments.

Embodiment 1

1. Adopting chemical plating to cover a nickel coating on aquadag, to reach 5% average content (weight percentage) of the aquadag, and 95% average weight percentage of nickel; this embodiment can be realize by following existing technology:

a) Firstly, using concentrated nitric acid to perform surface modification of aquadag powder. Specific process: putting 5 g aquadag powder into 20 ml concentrated nitric acid (40%), holding temperature at 80° C., and providing backflow for 3 h, filtering, washing and drying, for standby application.

b) Sensitizing treatment: putting surface-modified aquadag powder into 2 g/L $SnCl_2.2H_2O$ solution for sensitizing treatment for 10 minutes.

c) Putting well-sensitized aquadag powder into 0.1 g/L $PdCl_2$ solution, stirring for 10 minutes, filtering, washing, for standby application.

d) Putting well-treated aquadag powder into nickel sulphate plating solution, ultrasonic dispersion for 10 minutes. Then putting it into thermostatic bath, plating for 30 minutes with stirring, with temperature at 85° C. and pH of 5.6. After plating, conduct washing and filtering until pH value is close to neutral. Preparing Ni-coated aquadag powder Ni—C through in-situ reduction.

2. Further adopting the chemical plating to cover silver coating on nickel-coated aquadag, wherein afterwards an average percentage of silver in powder is less than 10%;

3. Putting Ag—Ni—C core-shell structural powder into a nitrogen protection sintering furnace for sintering granulation, with sintering temperature 800° C. Then sieving to remove superfine particles and remain the intermediate composite particle powder with granularity between −100 meshes-+400 meshes;

4. After sieving, mixing the Ag—Ni—C intermediate composite particle powder with pure silver powder to reach 1% average weight percentage of aquadag, then pouring the powder into a "V"-type blending machine for uniform mixing;

5. Putting well-mixed powder into a plastic volumetric cylinder with 90 cm diameter and 150 cm length for cold isostatic pressing at 200 Mpa;

6. Conducting nitrogen atmosphere sintering to bodyware produced by cold isostatic pressing with sintering temperature 865° C. for 5 hours; then conducting hot-pressing to the bodyware with temperature 800° C., pressure 700 MPa, for 10 minutes.

7. Conducting hot extrusion to hot-pressed bodyware with temperature 600° C., extrusion ratio 180, extrusion speed 5 cm/min and extrusion die preheating temperature 500° C.;

This embodiment finally obtains a new silver/nickel/graphite electrical contact material where aquadag particles present fibrous arrangement in a local region, while besides aquadag reinforcement, there are mainly nickel and a small quantity of silver. The electrical resistivity of obtained materials along a direction of extrusion is 2.3 μΩ·cm; and a hardness is 56 HV.

Embodiment 2

1. Adopting chemical plating to cover nickel coating on aquadag, to reach 10% average weight percentage of aquadag, and 90% average weight percentage of nickel;

2. Further adopting the chemical plating to cover silver coating on nickel-coated aquadag, wherein afterwards an average percentage of silver in powder is less than 10%; this embodiment can be realize by following existing technology:

Adding Ni—C powder into reducing solution with mechanical stirring dispersion for 5 minutes, and dropping silver-ammonia solution with a dropper into the reducing solution with mechanical stirring, in such a manner that silver ions are reduced depositing on Ni—C surface, then cleaning up with deionized water, and drying at 50° C., finally obtaining Ag—Ni—C powder with a core-shell structure.

In this embodiment, respectively preparing the silver-ammonia solution and reducing solution by 1:1; wherein preparation of the 50 ml reducing solution comprises: using 1.1 ml formaldehyde and adding water to 50 ml; preparation of the 50 ml silver-ammonia solution comprises: adding 1.75 g silver nitrate into 30 ml deionized water, after stirring, adding 10 ml aqua ammonia with constant stirring, and adding appropriate NaOH solution to improve PH value, then adding water to 50 ml.

3. Putting Ag—Ni—C core-shell structural powder into a nitrogen protection sintering furnace for sintering granulation, with sintering temperature 800° C. Then sieving to remove superfine particles and remain the intermediate composite particle powder with granularity between −100 meshes-+400 meshes;

4. After sieving, mixing the Ag—Ni—C intermediate composite particle powder with pure silver powder to reach 3% average weight percentage of aquadag, then pouring the powder into a "V"-type blending machine for uniform mixing at the speed of 30 R/M for 4 hours;

5. Putting well-mixed powder into a plastic volumetric cylinder with 90 cm diameter and 150 cm length for cold isostatic pressing at 200 Mpa;

6. Conducting nitrogen atmosphere sintering to bodyware produced by cold isostatic pressing with sintering temperature 865° C. for 5 hours;

7. Conducting hot-pressing to the sintered bodyware with temperature 800° C., pressure 700 MPa, for 10 minutes;

8. Conducting hot extrusion to hot-pressed bodyware with temperature 600° C., extrusion ratio 180, extrusion speed 5 cm/min and extrusion die preheating temperature 500° C.;

This embodiment finally obtains a new silver/nickel/graphite electrical contact material where aquadag particles present fibrous arrangement in a local region, while besides aquadag reinforcement, there are mainly nickel and a small quantity of silver. The electrical resistivity of obtained materials along a direction of extrusion is 2.2 μΩ·cm; and a hardness is 65 HV.

Embodiment 3

1. Adopting chemical plating to cover nickel coating on aquadag, to reach 30% average weight percentage of aquadag, and 70% average weight percentage of nickel;

2. Further adopting the chemical plating to cover silver coating on nickel-coated aquadag, wherein afterwards an average percentage of silver in powder is less than 10%;

3. Putting Ag—Ni—C core-shell structural powder into a nitrogen protection sintering furnace for sintering granulation, with sintering temperature 700° C. Then sieving to remove superfine particles and remain the intermediate composite particle powder with granularity between −100 meshes-+400 meshes;

4. After sieving, mixing the Ag—Ni—C intermediate composite particle powder with pure silver powder to reach 5% average weight percentage of aquadag, then pouring the powder into a "V"-type blending machine for uniform mixing at the speed of 30 R/M for 4 hours;

5. For the well-mixed powder in the step 4, adopting conventional method that powder-pressing, nitrogen protection atmosphere sintering, then extruding and drawing, finally obtaining a new silver/nickel/graphite electrical contact material.

This embodiment finally obtains the new silver/nickel/graphite electrical contact material where aquadag particles present fibrous arrangement in a local region, while besides aquadag reinforcement, there are mainly nickel and a small quantity of silver. The electrical resistivity of obtained materials along a direction of extrusion is 2.5 μΩ·cm; and a hardness is 60 HV.

Embodiment 4

1. Adopting chemical plating to cover nickel coating on aquadag, to reach 50% average weight percentage of aquadag, and 50% average weight percentage of nickel;

2. Further adopting the chemical plating to cover silver coating on nickel-coated aquadag, wherein afterwards an average percentage of silver in powder is less than 10%;

3. Putting Ag—Ni—C core-shell structural powder into a nitrogen protection sintering furnace for sintering granulation, with sintering temperature 900° C. Then sieving to remove superfine particles and remain the intermediate composite particle powder with granularity between −100 meshes-+400 meshes;

4. After sieving, mixing the Ag—Ni—C intermediate composite particle powder with pure silver powder to reach 10% average weight percentage of aquadag, then pouring the powder into a "V"-type blending machine for uniform mixing at the speed of 30 R/M for 4 hours;

5. For the well-mixed powder in the step 4, adopting existing method comprising cold isostatic pressing, nitrogen protection atmosphere sintering, then extruding and drawing, finally obtaining a new silver/nickel/graphite electrical contact material.

This embodiment finally obtains the new silver/nickel/graphite electrical contact material where aquadag particles present fibrous arrangement in a local region, while besides aquadag reinforcement, there are mainly nickel and a small quantity of silver. The electrical resistivity of obtained materials along a direction of extrusion is 3.0 μΩ·cm; and a hardness is 45 HV.

Embodiment 5

1. Adopting chemical plating to cover nickel coating on aquadag, to reach 60% average weight percentage of aquadag, and 40% average weight percentage of nickel;

2. Further adopting the chemical plating to cover silver coating on nickel-coated aquadag, wherein afterwards an average percentage of silver in powder is less than 10%;

3. Putting Ag—Ni—C core-shell structural powder into a nitrogen protection sintering furnace for sintering granulation, with sintering temperature 900° C. Then sieving to remove superfine particles and remain the intermediate composite particle powder with granularity between −100 meshes-+400 meshes;

4. After sieving, mixing the Ag—Ni—C intermediate composite particle powder with pure silver powder to reach 15% average weight percentage of aquadag, then pouring the powder into a "V"-type blending machine for uniform mixing;

5. Puting well-mixed powder into a plastic volumetric cylinder with 90 cm diameter and 150 cm length for cold isostatic pressing at 200 Mpa;

6. Conducting nitrogen atmosphere sintering to bodyware produced by cold isostatic pressing with sintering temperature 865° C. for 5 hours;

7. Conducting hot-pressing to the sintered bodyware with temperature 800° C., pressure 700 MPa, for 10 minutes;

8. Conducting hot extrusion to hot-pressed bodyware with temperature 600° C., extrusion ratio 180, extrusion speed 5 cm/min and extrusion die preheating temperature 500° C.;

This embodiment finally obtains a new silver/nickel/graphite electrical contact material where aquadag particles present fibrous arrangement in a local region, while besides aquadag reinforcement, there are mainly nickel and a small quantity of silver. The electrical resistivity of obtained materials along a direction of extrusion is 3.3μΩ·cm; and a hardness is 40 HV.

Embodiment 6

1. Adopting chemical plating to cover nickel coating on CdO powder, to reach 80% average content (weight percentage) of CdO, and 20% average weight percentage of nickel; this embodiment can be realize by following technology:

a) Dispersing before plating: wherein a dispersion effect of nano-particles relates directly to distribution and content of that in composite coating, and further directly affect composite coating property. Preferably, this embodiment adopts sodium alginate (or polyvinyl pyrrolidone) as dispersant. Specifically, firstly, using 200 ml absolute ethyl alcohol to wet 12.5 g CdO nano-particles; secondly, dissolving 7.5 g sodium alginate in 1 L deionized water; thirdly, slowly adding the CdO nano-particles wetted by absolute ethyl alcohol into sodium alginate solution, with ultrasonic dispersion and mechanical stirring; finally obtaining dispersion liquid;

b) Providing sensitization and activation: conducting sensitization and activation for above solution in 16 g/L $SnCl_2.2H$ O and 0.18 g/L $PdCl_2$ colloid pd activating solution; wherein in this process, Sn(OH)CL reduces $Pd^{2+}$ to be Pd; Pd sticks to a surface of matrix CdO where forms a catalytic activated center for chemical nickel-plating, and filtering, washing, for standby application.

c) Providing reduction: adopting 30 g/L $NaH_2PO_3.2H_2O$ solution as reducing solution; putting activating treated CdO powder particles into such reducing solution for 3 minutes to reduce the $Pd^{2+}$ that may remain on the surface, preventing plating solution from dissociation due to the $Pd^{2+}$ that may be brought into it. Then, through filtering, obtaining CdO powder sticking with Pd on surface, and preparing for chemical nickel-plating;

d) Chemical nickel-plating: slowly adding above well-treated CdO powder into well-mixed 200 ml chemical plating liquid (plating solution formula: 30 g/L nickel sulfate, 25 g/L sodium hypophosphite, 6 g/L sodium acetate anhydrous, 5.5 g/L sodium citrate, temperature 65° C., pH 4.5), wherein a plating temperature is (83±3)° C. and a plating time is 90 minutes, then washing with distilled water and get drying.

2. Chemical silver-plating: further adopting the chemical plating to cover silver coating on nickel-coated CdO, wherein afterwards an average percentage of silver in powder is less than 10%;

3. Puting Ag/Ni/CdO core-shell structural powder into a nitrogen sintering furnace for sintering granulation with sintering temperature 700° C. Then sieving to remove superfine particles and remain the intermediate composite particle powder with granularity between −100 meshes-+400 meshes;

4. After sieving, mixing the Ag/Ni/CdO intermediate composite particle powder with pure silver powder to reach 20% average weight percentage of CdO, then pouring the powder into a "V"-type blending machine for uniform mixing at the speed of 30 R/M for 4 hours;

5. Putting well-mixed powder into a plastic volumetric cylinder with 90 cm diameter and 150 cm length for cold isostatic pressing at 200 Mpa;

6. Conducting nitrogen atmosphere sintering to bodyware produced by cold isostatic pressing with sintering temperature 800° C. for 5 hours;

7. Conducting hot-pressing to the sintered bodyware with temperature 800° C., pressure 700 MPa, for 10 minutes;

8. Conducting hot extrusion to hot-pressed bodyware with temperature 600° C., extrusion ratio 180, extrusion speed 5 cm/min and extrusion die preheating temperature 500° C.;

This embodiment finally obtains a new Ag/Ni/CdO electrical contact material where cadmium oxide particles present fibrous arrangement in a local region, while besides CdO reinforcement, there are mainly nickel and a small quantity of silver. The electrical resistivity of obtained materials along a direction of extrusion is 3.9μΩ·cm; and a hardness is 87 HV.

Embodiment 7

1. Adopting chemical plating to cover nickel coating on $SnO_2$, to reach 60% average weight percentage of $SnO_2$, and 40% average weight percentage of nickel;

2. Further adopting the chemical plating to cover silver coating on nickel-coated $SnO_2$, wherein afterwards an average percentage of silver in powder is less than 10%; this embodiment can be realize by following existing technology:

Adding Ni—CdO powder into reducing solution with mechanical stirring dispersion for 5-minute, and dropping silver-ammonia solution with a dropper into reducing solution with mechanical stirring, in such a manner that silver ions are reduced depositing on Ni—CdO surface, then cleaning up with deionized water, and drying at 50° C., finally obtaining Ag/Ni/CdO powder with a core-shell structure.

In this embodiment, respectively preparing the silver-ammonia solution and reducing solution by 1:1; wherein preparation of the 50 ml reducing solution comprises: using 1.1 ml formaldehyde and adding water to 50 ml; preparation of the 50 ml silver-ammonia solution comprises: adding 1.75 g silver nitrate into 30 ml deionized water, after stirring, adding 10 ml aqua ammonia with constant stirring, and adding appropriate NaOH solution to improve PH value, then adding water to 50 ml.

3. Putting Ag/Ni/$SnO_2$ core-shell structural powder into a nitrogen sintering furnace for sintering granulation, with sintering temperature 800° C. Then sieving to remove superfine particles and remain the intermediate composite particle powder with granularity between −100 meshes-+400 meshes;

4. After sieving, mixing the Ag/Ni/$SnO_2$ intermediate composite particle powder with pure silver powder to reach 12% average weight percentage of $SnO_2$, then pouring the powder into a "V"-type blending machine for uniform mixing;

5. Putting well-mixed powder into a plastic volumetric cylinder with 90 cm diameter and 150 cm length for cold isostatic pressing at 200 Mpa;

6. Conducting nitrogen atmosphere sintering to bodyware produced by cold isostatic pressing with sintering temperature 800° C. for 5 hours;

7. Conducting hot-pressing to the sintered bodyware with temperature 700° C., pressure 700 MPa, for 10 minutes;

8. Conducting hot extrusion to hot-pressed bodyware with temperature 600° C., extrusion ratio 180, extrusion speed 5 cm/min and extrusion die preheating temperature 500° C.;

This embodiment finally obtains a new Ag/Ni/$SnO_2$ electrical contact material where $SnO_2$ particles present fibrous arrangement in a local region, while besides $SnO_2$ reinforcement, there are mainly nickel and a small quantity of silver. The electrical resistivity of obtained materials along a direction of extrusion is 3.0 μΩ·cm; and a hardness is 78 HV.

Embodiment 8

1. Adopting chemical plating to cover nickel coating on ZnO to reach 40% average weight percentage of ZnO, and 60% average weight percentage of nickel;

2. Further adopting the chemical plating to cover silver coating on nickel-coated ZnO, wherein afterwards an average percentage of silver in powder is less than 10%;

3. Putting Ag/Ni/ZnO core-shell structural powder into a nitrogen sintering furnace for sintering granulation, with sintering temperature 700° C. Then sieving to remove superfine particles and remain the intermediate composite particle powder with granularity between −100 meshes-+400 meshes;

4. After sieving, mixing the Ag/Ni/ZnO intermediate composite particle powder with pure silver powder to reach 10% average weight percentage of ZnO, then pouring the powder into a "V"-type blending machine for uniform mixing at the speed of 30 R/M for 4 hours;

5. For the well-mixed powder in the step 4, adopting existing method comprising cold isostatic pressing, nitrogen protection atmosphere sintering, then extruding and drawing, finally obtaining a silver/nickel/metallic oxide electrical contact material.

This embodiment finally obtains the new Ag/Ni/MeO electrical contact material where ZnO particles present fibrous arrangement in a local region, while besides ZnO reinforcement, there are mainly nickel and a small quantity of silver. The electrical resistivity of obtained materials along a direction of extrusion is 3.4 μΩ·cm; and a hardness is 75 HV.

Embodiment 9

1. Adopting chemical plating to cover nickel coating on $SnO_2$, to reach 50% average weight percentage of $SnO_2$, and 50% average weight percentage of nickel;

2. Further adopting chemical plating to cover silver coating on nickel-coated $SnO_2$, wherein afterwards an average percentage of silver in powder is less than 10%;

3. Putting Ag/Ni/$SnO_2$ core-shell structural powder into a nitrogen sintering furnace for sintering granulation, with sintering temperature 800° C. Then sieving to remove superfine particles and remain the intermediate composite particle powder with granularity between −100 meshes-+400 meshes;

4. After sieving, mixing the Ag/Ni/$SnO_2$ intermediate composite particle powder with pure silver powder to reach 8% average weight percentage of $SnO_2$, then pouring the powder into a "V"-type blending machine for uniform mixing;

5. For the well-mixed powder in the step 4, conducting cold isostatic pressing, nitrogen protection atmosphere sintering, then extruding and drawing, finally obtaining a silver/nickel/metallic oxide electrical contact material;

This embodiment finally obtains the new Ag/Ni/$SnO_2$ electrical contact material where $SnO_2$ particles present fibrous arrangement in a local region, while besides $SnO_2$ reinforcement, there are mainly nickel and a small quantity of silver. The electrical resistivity of obtained materials along a direction of extrusion is 2.5 μΩ·cm; and a hardness is 70 HV.

The present invention adopts chemical plating to cover the nickel coating on the aquadag or the metallic oxide particles, and then covers with the silver coating, forming the Ag—Ni—C core-shell structural composite powder. Therein the above embodiments operation can realize chemical nickel-plating and silver-plating, but not limited to, also realized by other existing chemical plating ways. The existing technologies can realize the techniques of the present invention such as powder-mixing, powder-pressing, nitrogen protection atmosphere sintering, extruding and drawing, but not limited to the operation and process parameters of above embodiments.

These are partial embodiments of the present invention. It should be noted that the present invention also has other implementation ways, such as changing implementation parameter or replacing the corresponding operation of above embodiments with existing technologies. Although the content of the present invention is introduced in detail by means of above embodiments, should realize that above description shouldn't be considered as a limitation to the present invention. After consulting above content, it is apparent for technicists in this field to do various modification and replacement to the present invention. Therefore, the protection scope of the present invention should be limited by the attached claims.

What is claimed is:

1. A preparation method of an electrical contact material, comprising following steps of:

$1^{st}$ step, coating water-based colloid graphite or metallic oxide particles with nickel through chemical plating;

$2^{nd}$ step, further coating the water-based colloid graphite or the metallic oxide particles with the nickel coating by the $1^{st}$ step with silver through chemical plating;

$3^{rd}$ step, under nitrogen atmosphere, conducting sintering granulation to powder of Ag—Ni—C or Ag—Ni—MeO core-shell structure which is formed by the $2^{nd}$ step, and obtaining intermediate composite particle powder, then sieving;

$4^{th}$ step, mixing the intermediate composite particles after sieving by the $3^{rd}$ step with pure silver powder to reduce a content of water-based colloid graphite or metallic oxide to a setting value; and $5^{th}$ step, making well-mixed powder of the $4^{th}$ step pressed and nitrogen protection atmosphere sintered, then extruding and drawing to obtain the electrical contact material where the water-based colloid graphite or the metallic oxide particles present fibrous arrangement in a local region; wherein in the local region, there are mainly nickel and a small quantity of silver besides water-based colloid graphite reinforcement or metallic oxide reinforcement.

2. The preparation method, as stated in claim 1, wherein, the 1st step specifically comprises: coating the water-based colloid graphite with the nickel through the chemical plating, to reach 5%-60% average weight percentage of the water-based colloid graphite, and 40%-95% average weight percentage of the nickel.

3. The preparation method, as stated in claim 2, wherein, in the 2nd step, an average percentage of the silver in the powder is less than 10% after using the chemical plating for silver coating.

4. The preparation method, as stated in claim 2, wherein, in the 3rd step, a temperature of the sintering granulation is 700° C.–900° C.

5. The preparation method, as stated in claim 2, wherein, the 3rd step further comprises sieving the intermediate composite particle powder for remaining granularity between −100 meshes-+400 meshes.

6. The preparation method, as stated in claim 2, wherein, the 4th step specifically comprises mixing the intermediate composite particles with the pure silver powder to reduce the average weight percentage of the water-based colloid graphite to 1%-15%.

7. The preparation method, as stated in claim 1, wherein, the 1st step specifically comprises coating the metallic oxide with the nickel through the chemical plating, to reach 40%-80% average weight percentage of the metallic oxide, and 20%-60% average weight percentage of the nickel.

8. The preparation method, as stated in claim 7, wherein, in the 2nd step, an average percentage of the silver in the powder is less than 10% after adopting the chemical plating for silver coating.

9. The preparation method, as stated in claim 7, wherein, in the 3rd step, a temperature of the sintering granulation is 700° C.-900° C.

10. The preparation method, as stated in claim 7, wherein, the 3rd step further comprises sieving the intermediate composite particle powder for remaining granularity between −100 meshes-+400 meshes.

11. The preparation method, as stated in claim 7, wherein, the 4th step specifically comprises mixing the intermediate composite particles with the pure silver powder to reduce the average weight percentage of the metallic oxide to 8%-20%.

12. The preparation method, as stated in claim 1, wherein, in the 2nd step, an average percentage of the silver in the powder is less than 10% after using the chemical plating for silver coating.

13. The preparation method, as stated in claim 1, wherein, in the 3rd step, a temperature of the sintering granulation is 700° C.–900° C.

14. The preparation method, as stated in claim 1, wherein, the 3rd step further comprises sieving the intermediate composite particle powder for remaining granularity between −100 meshes-+400 meshes.

15. The preparation method, as stated in claim 1, wherein, the 4th step specifically comprises mixing the intermediate composite particles with the pure silver powder to reduce the average weight percentage of the water-based colloid graphite to 1%-15%.

16. The preparation method, as stated in claim 1, wherein, the 4th step specifically comprises mixing the intermediate composite particles with the pure silver powder to reduce the average weight percentage of the metallic oxide to 8%-20%.

17. The preparation method, as stated in claim 1, wherein the metallic oxide comprises CdO, $SnO_2$, ZnO, CuO, $Ni_2O$, $WO_3$ and mixtures thereof.

18. An electrical contact material, prepared by the method as stated in claim 1, wherein: in the electrical contact material, water-based colloid graphite particles or metallic oxide particles present fibrous arrangement in a local region, wherein a fibrous structure consists of orientation arrangement of the water-based colloid graphite particles or the metallic oxide particles; besides water-based colloid graphite reinforcement or metallic oxide reinforcement in the local region, there are mainly nickel and a small quantity of silver.

* * * * *